US006453051B1

(12) United States Patent
Killion

(10) Patent No.: US 6,453,051 B1
(45) **Date of Patent: *Sep. 17, 2002**

(54) HEARING AID WITH AUDIBLE ALARM

(75) Inventor: Mead C. Killion, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/685,706

(22) Filed: Oct. 10, 2000

Related U.S. Application Data

(63) Continuation of application No. 08/161,691, filed on Dec. 3, 1993, which is a continuation of application No. 08/033,943, filed on Feb. 16, 1993, now abandoned, which is a continuation of application No. 07/416,703, filed on Oct. 3, 1989, now abandoned, which is a continuation-in-part of application No. 07/414,903, filed on Sep. 29, 1989, now abandoned.

(51) Int. Cl.[7] ..... H04R 25/00

(52) U.S. Cl. ..... 381/315; 381/312; 340/407; 340/626

(58) Field of Search ..... 381/315, 312, 381/FOR 137; 340/407, 626

(56) References Cited

U.S. PATENT DOCUMENTS

| | | | | |
|---|---|---|---|---|
| 4,049,930 | A | * | 9/1977 | Fletcher |
| 4,284,944 | A | * | 8/1981 | Iwanaga |
| 4,777,474 | A | * | 10/1988 | Clayton |
| 4,910,795 | A | * | 3/1990 | McCowen |
| 5,343,532 | A | * | 8/1994 | Shugart |
| 5,420,930 | A | * | 5/1995 | Shugart |
| 5,666,331 | A | * | 9/1997 | Kollin |
| 5,680,112 | A | * | 10/1997 | Xydis |
| 6,067,006 | A | * | 5/2000 | O'brien |
| 6,320,969 | B1 | * | 11/2001 | Killion |

* cited by examiner

*Primary Examiner*—Curtis Kuntz
*Assistant Examiner*—Dionne N Harvey
(74) *Attorney, Agent, or Firm*—McAndrews, Held & Malloy, Ltd.

(57) ABSTRACT

A low battery detection circuit is disclosed for detecting low battery voltages in hearing aids and other battery operated devices. The low battery detection circuit operates reliably on a small amount of current, which does not significantly increase overall battery drain. An output signal is generated whose amplitude and frequency increase as battery voltage decreases below a predetermined level. The circuit's minimal number of components and output signal characteristics make it particularly applicable as a low battery early warning device for hearing aid devices.

15 Claims, 6 Drawing Sheets

HEARING AID WITH AUDIBLE ALARM

CROSS REFERENCE TO RELATED APPLICATION

This application is a continuation of U.S. application Ser. No. 08/161,691 filed Dec. 3, 1993, which is a continuation of application Ser. No. 08/033,943 filed Feb. 16, 1993, now abandoned, which is a continuation of application Ser. No. 07/416,703 filed Oct. 3, 1989, now abandoned, which is a continuation-in-part of application Ser. No. 07/414,903, filed Sep. 29, 1989, now abandoned.

INCORPORATION BY REFERENCE

U. S. application Ser. No. 08/161,691 filed Dec. 3, 1993, U.S. application Ser. No. 08/033,943 filed Feb. 16, 1993, U.S. application Ser. No. 07/416,703 filed Oct. 3, 1989, and U.S. application Ser. No. 07/414,903 filed Sep. 29, 1989, are hereby incorporated by reference herein in their entirety.

STATEMENT REGARDING FEDERALLY SPONSORED RESEARCH OR DEVELOPMENT

N/A

BACKGROUND OF THE INVENTION

This invention relates to an alarm circuit for a hearing aid, which can provide advance warning that the battery is approaching its end of life, and/or function as an increased-audibility alarm to provide wake-up or other-purpose alarm signals to the hearing impaired wearer. Unlike other increased-audibility alarms for the hearing impaired, the alarm circuit of the invention is private and not annoying to those around the wearer.

There are many low battery detector circuits on the market. These typically include a plurality of discrete components or are contained in a separate integrated circuit designed for that purpose, and typically operate in a binary manner: No output until the battery voltage drops below the detector threshold, then full output in the form of a warning light, series of beeps, or the like.

The prior art also includes arrangements particularly for testing batteries used in conjunction with hearing aids. Oticon Corporation manufactures a behind-the-ear hearing aid incorporating a battery test switch, with an LED readout, eliminating the need for a separate battery tester. A low-battery indication is built into the hand-held remote control transmitter used with Widex Corporation's "QUATRO" remote-controlled hearing aids to monitor the battery in the transmitter although not the one in the hearing aid itself.

SUMMARY OF THE INVENTION

This invention was evolved with the general object of providing a simple and effective arrangement by which the user of a hearing aid might be alerted to low battery or other alarm conditions.

Important aspects of the invention relate to the recognition of problems with prior art arrangements and the causes thereof. The space and circuitry requirements of low battery detector circuits of the prior art are such that they cannot be practically included in a hearing aid. In my aforementioned application, of which this is a continuation-in-part, a circuit is disclosed which is such that it can be incorporated in a hearing aid, having the important advantage that it can use the existing audio amplifier circuitry of the hearing aid for producing an audible indication of the low battery. That circuit has the additional advantage of providing a warning whose loudness and signal frequency progressively increases as the battery falls lower and lower below the preset threshold. It is quite simple and can be added to a hearing aid integrated circuit amplifier with little additional area required on the chip.

It is has been found that there are instances in which a user may desire to disable the warning signal until such time as he may conveniently change the battery, or in which the user may desire additional features and, in accordance with an important feature of the invention, the user of a hearing aid is provided with a manual means of disabling the low battery warning signal once it has been heard.

Another important feature relates to an arrangement with provides the user with the option of using the on-off switch of the hearing aid as the disabling switch, in order to avoid the additional space and expense required by a separate disabling switch.

A further feature of this invention relates to the provision of an automatic means of limiting the percentage of time the low-battery warning is audible, in order that it not become annoying before he has time to change the battery.

Still another feature of the invention relates to the provision of a wake-up or other alarm that is easily heard privately by the hearing impaired wearer, but which is not disturbing to those around him or her.

The invention also provides automatic means of increasing the audibility of the warning or alarm signal until such time as the hearing aid wearer signals that he has heard the signal and turns off the alarm.

These and other objects, features and advantages will become more fully apparent from the following detailed description taken in conjunction with the accompanying drawings.

DETAILED DESCRIPTION OF THE INVENTION

Figures 1, 1A:
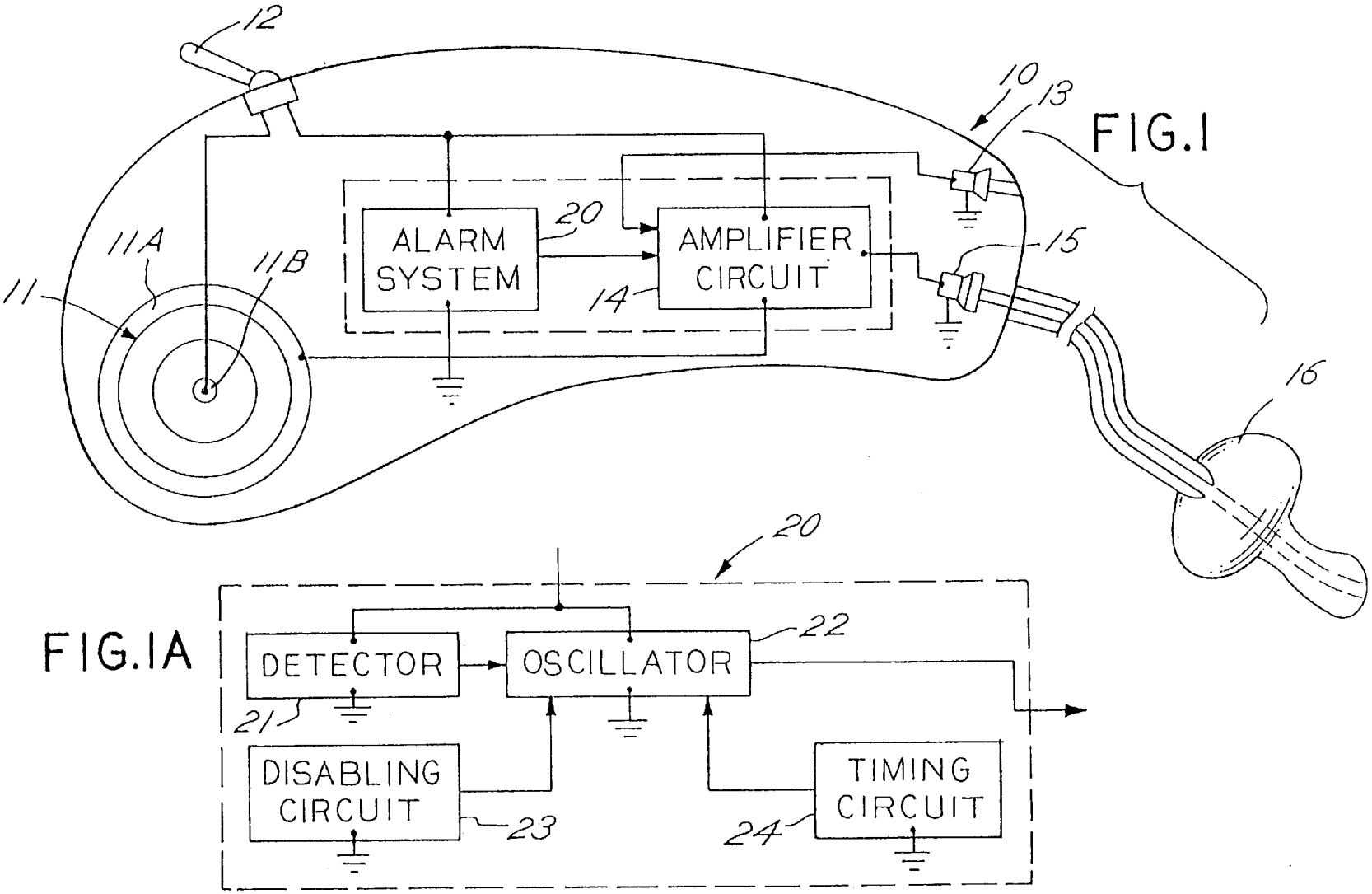
FIG. 1 illustrates diagrammatically a hearing aid which is constructed in accordance with the invention.
FIG. 1A is a block diagram of an alarm system usable in the hearing aid of FIG. 1.

FIG. 1 shows a hearing aid 10 which is constructed in accordance with the principles of the invention and which includes a battery 11, on-off switch 12, microphone 13, amplifier 14, earphone 15, earpiece 16 for coupling the hearing aid output to an ear, and an alarm system 20. The battery 11 may be a battery of the disc type having a negative end engaged with a grounded terminal 11A and with a positive end engaged with a terminal 11B which is connected to the on-off switch 12.

FIG. 1A shows an alarm system 20 as in FIG. 1, which alarm system may include battery level detector 21, includes oscillator 22, and may also include disabling means 23, and timing means 24.

Figure 2:
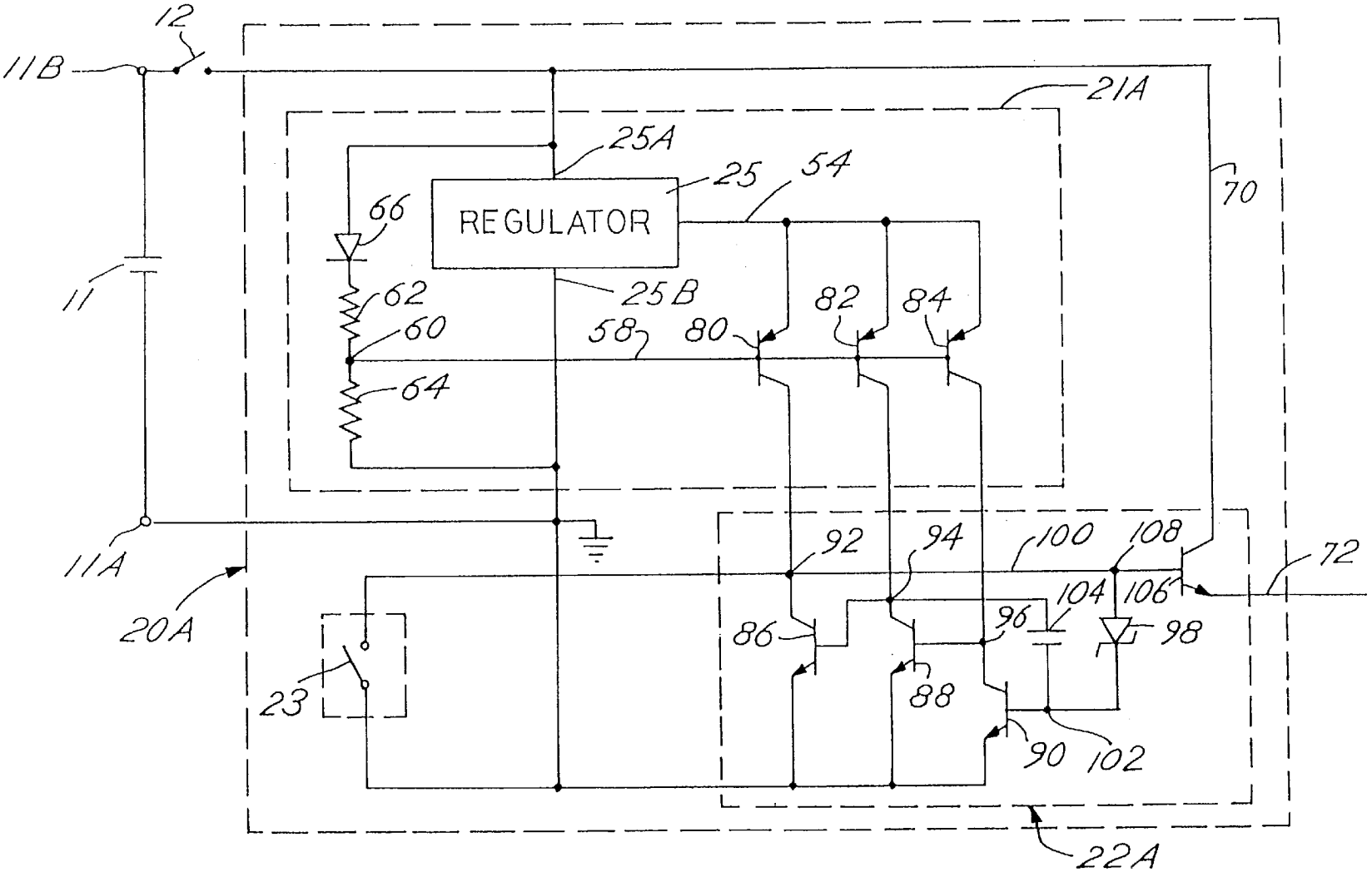
FIGS. 2, 3, 4, 5, 6 and 7 show various forms of alarm systems usable in the hearing aid of FIG. 1.

FIG. 2 shows one preferred embodiment 20A of alarm system 20 in which detector 21A contains a voltage dependent triple of current sources operating as described in aforementioned patent application dated September 29, 1989, and current-dependent oscillator 22A also functions as described in aforementioned patent application, with a switch means 23 connected to disable its operation. It should be understood that a low-voltage non-contacting touch-sensitive integrated circuit switch such as manufactured by Gennum Corporation of Canada may be used as the switch means 23.

It should also be noted that for purposes of this description the word battery will be used to describe both multiple-cell and single-cell power sources, the latter being more typical in hearing aid applications.

The battery voltage of battery 11 is determined by the power requirements of the battery operated device which uses it. While the present invention is in no way limited to the type of battery operated devices which would benefit from the use of the illustrated low battery detection circuitry, the operation of the illustrated circuitry will be discussed with reference to a nominal single-cell battery voltage of 1.3 volts D.C. This battery voltage is typical of batteries used to power hearing aids, the application in which the low battery detection circuit 50 is presently used. The illustrated circuitry, however, is not limited to hearing aid applications and may be used in any battery powered electronic apparatus whose utility would be enhanced by the operation of the low battery detection circuit.

The low battery detection circuit 21A is powered by three different voltage values, two voltages derived from battery 11 and the actual voltage of battery 11. Detection circuit 21A detects the difference between a regulated voltage and a reduced tracking voltage which tracks battery voltage as battery voltage decreases during operation.

In the present embodiment, a regulator 25 is used to develop a regulated voltage of 0.84 volts. This voltage level is chosen to be sufficiently below the minimum operating voltage at which the hearing aid effectively operates. This permits the low battery detection circuit to indicate a low battery state before actual device operation is impaired. It will be understood that proper operation can be obtained with a choice of regulator voltage somewhat different from 0.84 Volts, and the exact choice can be made depending on the nominal battery voltage, the desired low-voltage detection level, and other circuit requirements on the regulator.

The regulated voltage of 0.84 volts is developed from the battery voltage. The regulator input, indicated by line 25A, is connected through the on-off switch 12 to positive terminal 1B of battery 11. The regulator common terminal 25B is connected to the negative terminal 1A of battery 11 which forms a circuit ground. The regulator output 25C of 0.84 volts is connected to a line 54 which forms a regulated voltage input of a low battery detection circuit.

A line 58 forms a tracking input 58 of a low battery detection circuit and receives a reduced tracking voltage developed at common node 60 of resistor 62 and resistor 64. The reduced tracking voltage is derived from the battery voltage of battery 11. The anode of diode 66 is connected to positive terminal 11B of battery 11. The cathode of diode 66 is connected to one end of resistor 62. The other end of resistor 62 is connected to one end of resistor 64. The other end of resistor 64 is connected to ground. The reduced tracking voltage at common point 60 tracks the battery voltage as the battery voltage decreases during hearing aid operation. The values of resistors 62 and 64 are chosen such that the voltage derived at common point 60 is approximately 0.4 volts below the regulated voltage of 0.84 volts when the battery voltage drops to approximately 1.15 volts. It is the difference between the regulated voltage of 0.84 volts at regulated voltage input 54 and the reduced tracking voltage at tracking input 58 which controls the operation of low battery detection circuit 21A.

A supply input 70 of low battery detection circuit 50 is coupled through switch 12 to positive terminal 11B of battery 11. Supply input 70 receives the actual voltage of battery 11.

The low battery detection circuitry develops an output signal which is coupled through output 72 to amplifier 14. The output signal at output 72 is an AC signal having both amplitude and frequency characteristics which indicate the extent to which the battery voltage has dropped from nominal. This output signal reflects the voltage difference which occurs between regulated voltage input 54 and tracking input 58. As the voltage at tracking input 58 decreases with decreasing battery voltage, the voltage difference between voltage input 54 and tracking input 58 increases. This voltage difference determines the frequency rate and amplitude level of the output signal at output 72.

The illustrated low battery detection circuitry uses a three-stage oscillator driven by a voltage dependent triplet of current sources. The voltage dependent triplet of current sources includes three PNP transistors 80, 82, and 84. The current delivered by PNP transistors 80, 82, and 84 varies according to the voltage difference between the voltages at regulated voltage input 54 and tracking input voltage 58. The regulated voltage developed by regulator 25 is coupled to the emitters of PNP transistors 80, 82, and 84 through regulated voltage input 54. The tracking voltage developed at common node 60 is connected to the base of each of the PNP transistors 80, 82, and 84 through tracking voltage input 58. As battery voltage decreases the voltage level at the bases of the PNP transistors 80, 82 and 84 also decreases. This creates an increasing voltage between the emitter and base of each PNP transistor. This action increases the current flowing through the collectors of PNP transistors 80, 82, and 84.

An oscillator of the circuitry is composed of three NPN transistors 86, 88, and 90. The emitter of each NPN transistor is coupled to ground. The collector of each NPN transistor is coupled to its corresponding current source, such that the collector of transistor 86 is coupled to the collector of transistor 80 at point 92, the collector of transistor 88 is coupled to the collector of transistor 82 at point 94, and the collector of transistor 90 is coupled to the collector of transistor 84 at point 96. These collector-collector connectors provide the necessary current to drive the oscillator.

The oscillator is DC biased for stable operation by Schottky diode 98 whose anode is coupled to point 92 through a line 100 and whose cathode is coupled to the base of transistor 90 at point 102. A positive feedback capacitor 104 is connected to the collector of transistor 88 at point 94 and the base of transistor 90 at point 102. In the preferred embodiment, the value of capacitor 104 is 50 picofarads, a capacitance which is easily included in an integrated circuit chip. As shown, line 100 may be connected to ground through the disabling switch 23.

An NPN transistor 106 is arranged in an emitter follower configuration to supply an output signal at output 72 to amplifier 14. The collector of transistor 106 is coupled to the positive terminal 11B of battery 11 through supply input 70. The emitter of transistor 106 is coupled to output 72. The base of transistor 106 is coupled to the anode of diode 98 at point 108 which in turn connects it to the collector of transistor 86 at point 92 through line 100.

As previously stated, the frequency rate and the amplitude level of the output signal depends upon the voltage difference between regulated voltage input 54 and tracking input 58. This voltage difference is applied across the base-emitter junctions of each PNP transistor 80, 82 and 84. When the battery voltage drops to 1.15 volts, approximately 0.4 volts is applied between the base-emitter junctions of those PNP transistors which in turn supply approximately 2 nanoamps of current to the collectors of each NPN transistor 86, 88 and 90. This current is available to charge capacitor 104. As capacitor 104 is charged by the current provided by transistor 82, transistor 90 conducts. The conduction of transistor 90 causes point 96 to be essentially at ground. Since transistor 88 is in a cutoff condition, the current delivered to point 94 by transistor 82 is coupled to the base of transistor 86, turning transistor 86 on. At this point transistors 86 and 90 are turned on and transistor 88 is turned off.

Once capacitor 104 approaches a full charge, the current to the base of transistor 90 is reduced sufficiently to force transistor 90 into a state of cutoff so that current from transistor 84 flows into the base of transistor 88. Transistor 88 then conducts, forcing point 94 to ground and driving transistor 86 into cutoff. Now, transistor 88 is turned on and transistors 86 and 90 are turned off.

Since capacitor 104 has one lead connected to point 94 and transistor 88 is turned on, and since transistor 86 is turned off so that the other lead of capacitor 104 is receiving current from transistor 80 through Schottky diode 98, the capacitor 104 begins to discharge and then recharge in the opposite direction. Once capacitor 104 has recharged sufficiently in the opposite direction, transistor 90 begins to conduct using current supplied through diode 98. Once transistor 90 conducts sufficiently to absorb essentially all of the current from transistor 84, transistor 88 will return to the off state, whereupon the current from transistor 82 will again be available to charge capacitor 104 in the original direction. At this point, both Schottky diode 98 and capacitor 104 supply current into the base of transistor 90. Once capacitor 104 has charged sufficiently, current from transistor 82 will flow into the base of transistor 86, turning it on. The circuit is now back to the state in which transistors 86 and 90 are turned on and the transistor 88 is turned off. This cycle repeats, creating an AC output signal at the base of transistor 106, which is amplified by transistor 106 and coupled to amplifier input 74 through output 72. In the case of a hearing aid, an amplifier receiving the output signal is coupled to a receiver providing an audible warning signal to the user indicating low battery voltage.

As the voltage difference between regulated voltage input 54 and tracking input 58 increases due to reduced battery voltage, the collector currents of transistors 80, 82, and 84 increase. Since nearly 80% of the drop in battery voltage is applied to the base-emitter junctions of the current source transistors, the collector current approximately doubles for each 20 millivolt drop in battery voltage.

With an initial 2 nanoamps of charge current and the value of capacitor 104 established at 50 picofarads, charging of capacitor 104 takes approximately 10 milliseconds. Therefore, a complete cycle takes approximately 20 milliseconds setting the oscillation frequency at approximately 50 Hertz. In this circuit, a doubling of the collector current produces a doubling in the frequency of oscillation. The base current supplied to transistor 106 is also doubled. The resulting output waveform at output 72 therefore increases audibility for two reasons: first, the audibility at a constant sound pressure level increases rapidly with frequency above 50 hertz for most people with a hearing loss except those having extreme forms of hearing loss at higher frequencies, and second, the sound pressure level generated at the output of the hearing aid is typically more than doubled for each 20 millivolt drop in battery voltage because of the increased pulse current and the rising gain-vs-frequency characteristic of a typical hearing aid. These results produce a highly useful circuit function wherein even a 10 millivolt decrease in battery voltage will create a readily noticeable increase in the apparent urgency of the warning signal.

As mentioned above, the audible alarm of the present invention is heard privately (e.g., only) by a hearing aid user or wearer. In addition, as is apparent from FIG. 2 and the associated description, for example, the audible alarm and the audio received by the hearing aid microphone can be heard simultaneously by the user.

Figure 3:
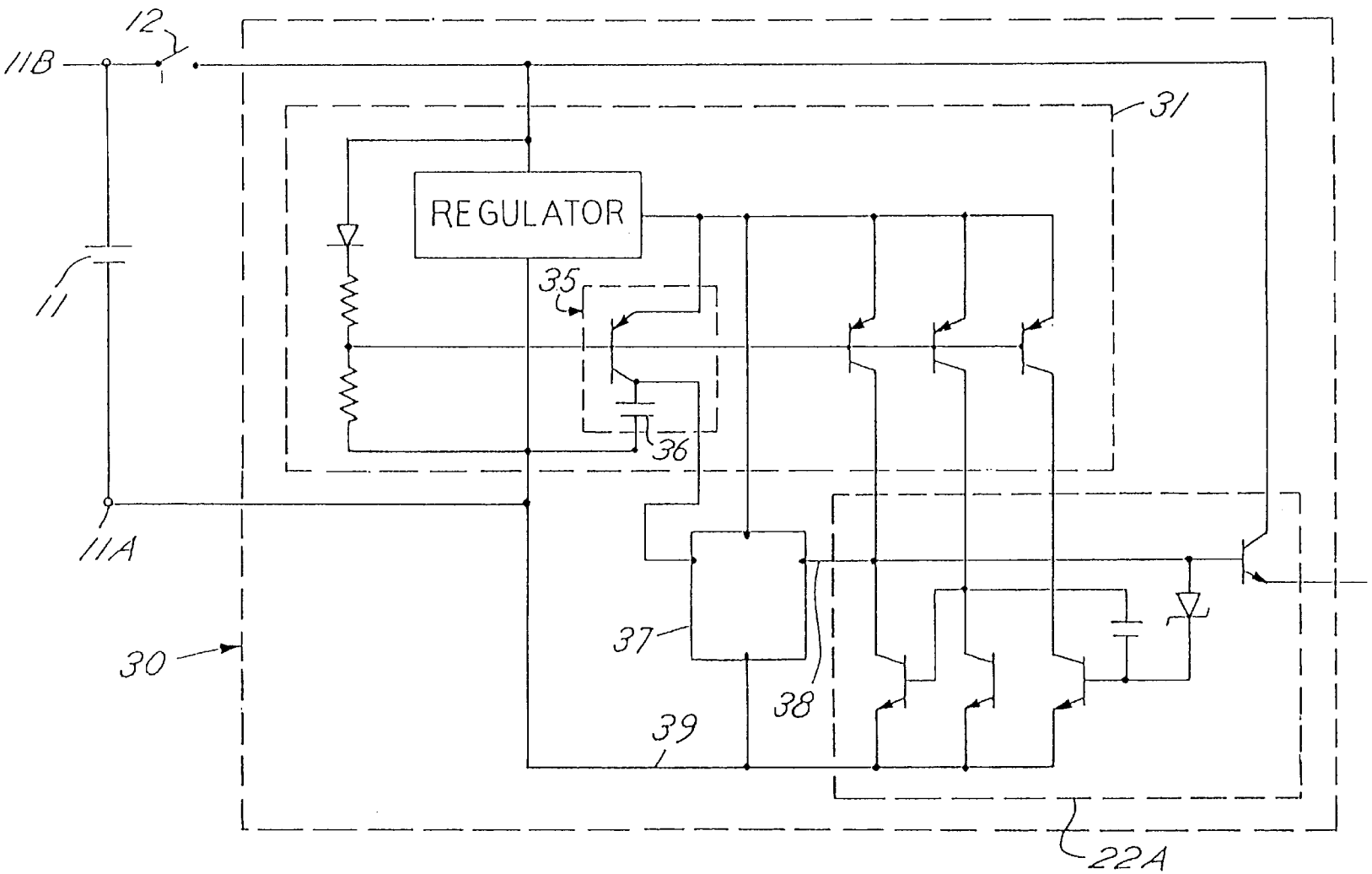

FIG. 3 shows a different variation 30 of alarm system 20 of FIG. 2, in which low-battery-detection circuit 31 enables a capacitor charging circuit 35 which is configured to retain charge on hold capacitor 36 long enough for the battery to be disconnected and reconnected quickly (by operation of the on-off switch of the hearing aid or by opening the battery drawer) while still biasing logic switch 37 so that it disables alarm oscillator 22A by providing a relatively low impedance path between output line 38 and ground 39 as soon as the battery is reconnected. In this manner, a manual shut off of the alarm is provide without requiring a separate switch in the hearing aid. It will be understood that any oscillator capable of being disabled by a logic signal may be substituted for oscillator 22A.

Figure 4:
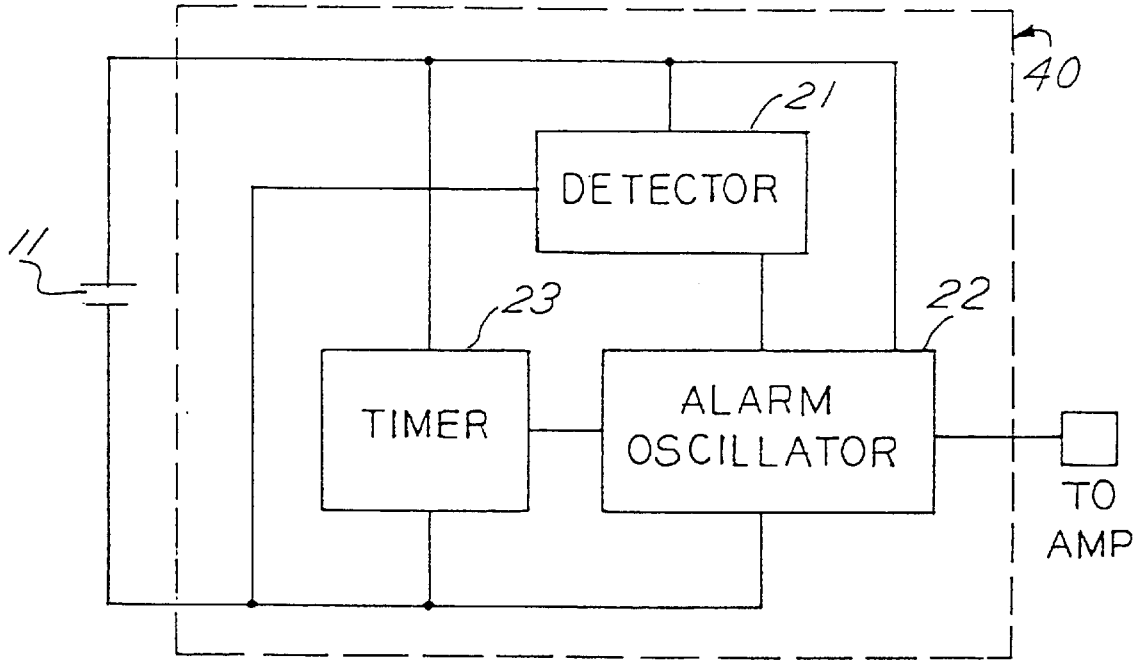

FIG. 4 shows an alternate embodiment in which alarm system 40, which may be substituted for alarm system 20 in FIG. 1, contains detector 21, alarm oscillator 22, and timer 23. Timer 23 may be a low-battery-drain watch-circuit type of integrated circuit which has-been preprogrammed to periodically enable the low-battery warning alarm for a desirable period of time such as 3 seconds and then disable the low-battery warning system for a desirable quiescent period such as 10 minutes. Alarm system 40 automatically renders the operation of the low-battery warning system less obtrusive, while still accomplishing its primary function of providing advance warning of the impending end-of-life of the battery.

Figure 5:
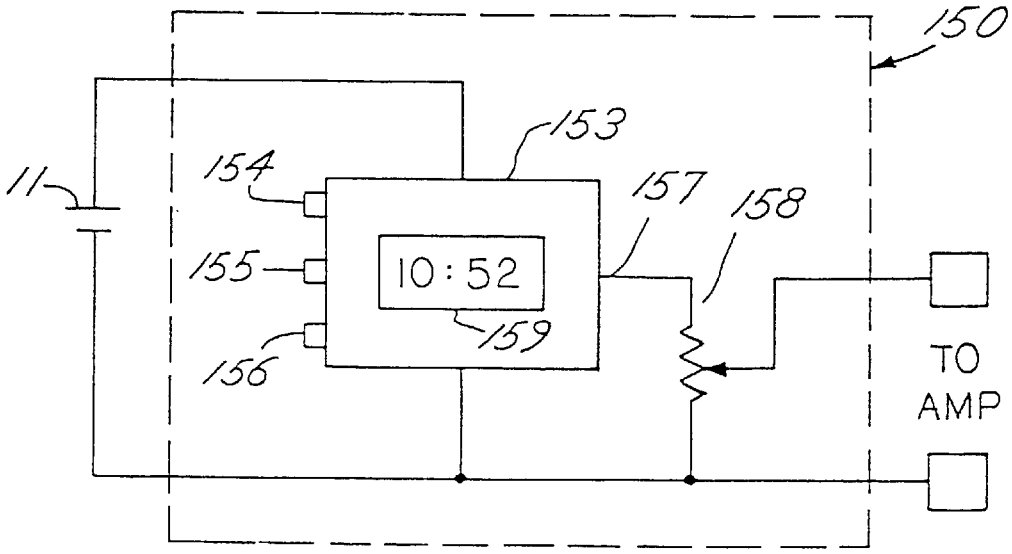

FIG. 5 shows alarm system 150 which may be substituted for alarm system 20 in FIG. 1. Alarm system 150 contains a watch/alarm means 153 such as is readily available in low-battery-drain digital watch circuits and can be set by means of setting switches 154, 155, and 156 in the usual manner, but whose alarm output 157 is amplified by the hearing aid in an amount controlled by attenuator 158. Attenuator 158 may be adjusted by the hearing aid dispenser or hearing aid wearer so that the alarm is readily audible to the wearer, regardless of the degree of his hearing loss, in order that he will not fail to hear the alarm. Setting the time and alarm may be accomplished in a conventional manner if a miniature watch LCD readout 159 and aforementioned push buttons 154, 155, and 156 are incorporated into the hearing aid case. It should be understood that the recent development of remote control programmers for hearing aids now permits the convenient setting of the alarm function by remote control, avoiding any change in the external appearance of the hearing aid, providing only that switch means 154, 155, and 156 are remotely programmed.

Figure 6:
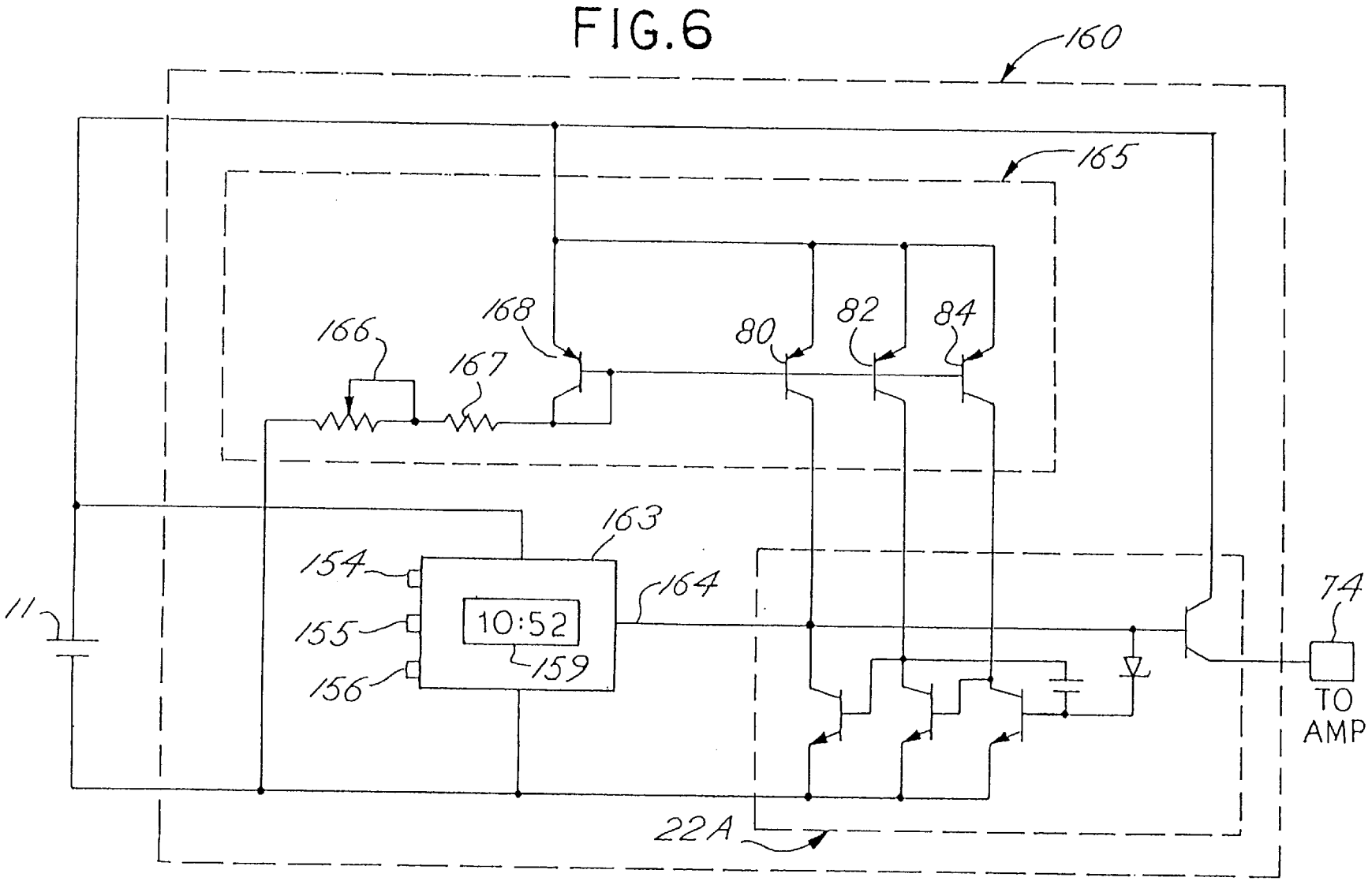

FIG. 6 shows alarm system 160, which may be substituted for alarm system 20 in FIG. 1, and which incorporates timer 163 with setting switches 154, 155, and 156 and readout 159, but whose output 164 replaces switch 23 of FIG. 2 in disabling an alarm oscillator such as alarm oscillator 22A as shown, so that only when an alarm signal is desired is output 164 in the enabling (effectively open circuit) condition.

The alarm system 160 also contains alarm oscillator adjustment means 165, with the variable resistance 166 adjustable so that in cooperation with fixed resistance 167 the base-emitter voltage of large-area PNP transistor 168 and thus the current supplied by current sources 80, 82, and 84 may be controlled, controlling in turn the amplitude and signal frequency of alarm oscillator 22A as described in the aforementioned patent application. In this manner, the output of alarm oscillator 22 can be adjusted by the hearing aid dispenser or user for optimum audibility to the hearing impaired user. The advantage of the circuits of FIGS. 5 and 6 is that the hearing aid wearer will be able to receive privately an alarm which might otherwise be so loud as to disturb others.

Figure 7:
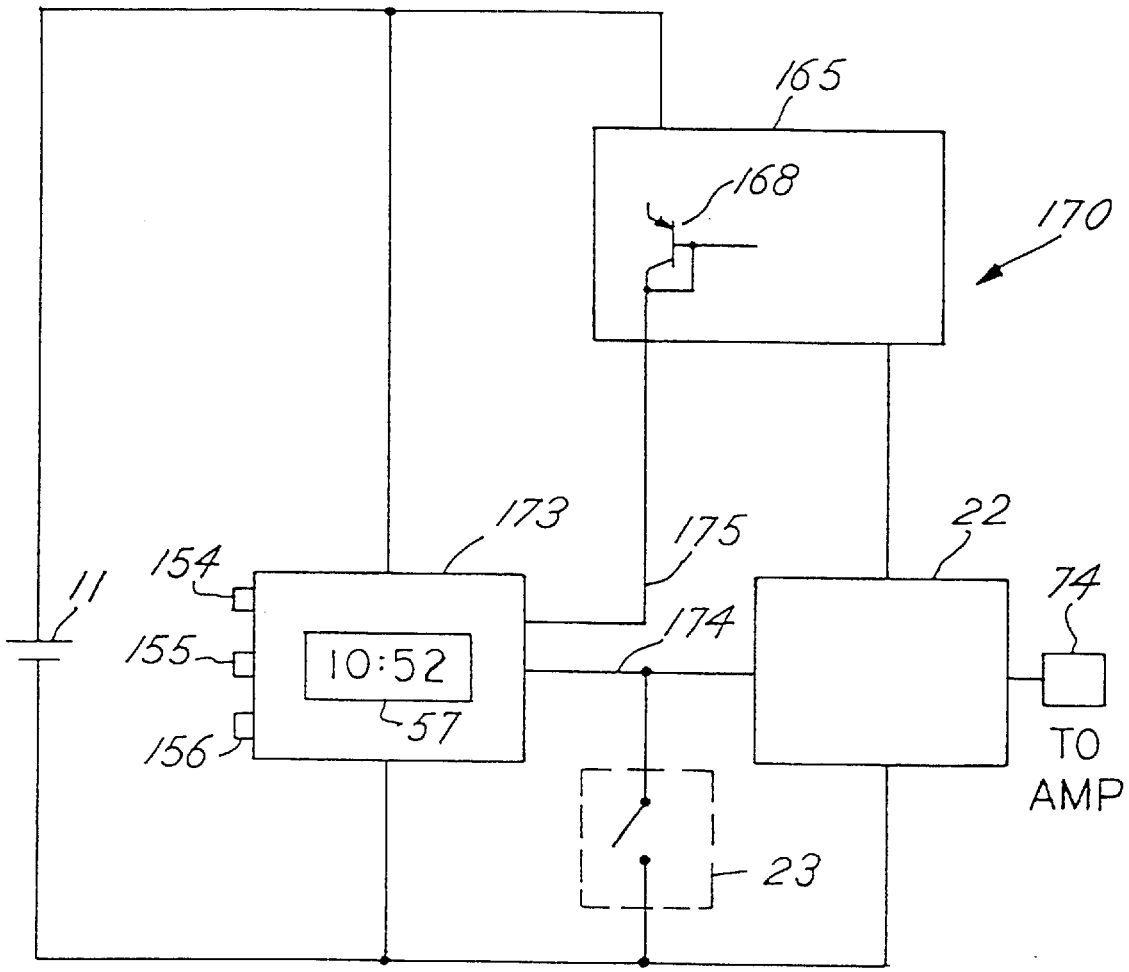

FIG. 7 shows alarm system 170, which may be substituted for alarm system 20 in FIG. 1, and which incorporates timer 173 which in turn has two outputs, one output 174 acting as above to provide a timed alarm function, while the other output 175 acts to cause increasing audibility with time of the alarm signal. For example, if output 175 is programmed so that every 10 seconds it provides a doubling in the control current drawn from PNP transistor 168 in alarm oscillator adjustment means 165 of FIG. 6, the audible output of alarm oscillator 22 will increase by approximately 20 dB in hearing level every 10 seconds until the alarm is heard, whereupon it may be disabled by the user with disabling means 23. With alarm system 170, no individual manual setting of the alarm amplitude or signal frequency needs to be made in order that all users will automatically hear the alarm sooner or later, regardless of their hearing loss.

It will be understood that modifications and variations may be effected without departing from the spirit and scope of the novel concepts of the invention.

I claim:

1. A hearing aid comprising:

a hearing aid housing;

a microphone for receiving audio and for generating therefrom audio signals;

an amplifier for amplifying input signals, said amplifier having a first input connected to receive the audio signals generated by said microphone, a second input, and an output supplying amplified signals corresponding to signals received at said first and second inputs;

an earphone connected to receive said signals from said output of said amplifier and for converting said signals into sound energy;

a battery connected to supply power to said amplifier;

an alarm system mounted with the hearing aid housing for generating an audio alarm signal representative of an audible alarm in response to the voltage output of said battery falling below a predetermined threshold value, said audio alarm signal being directly connected for receipt by said second input of said amplifier such that both said audible alarm and said audio received by said microphone can be heard simultaneously by a user, said audible alarm being transmitted into the ear canal of the user such that the audible alarm is heard only by the user.

2. A hearing aid as claimed in claim 1 and further comprising means for disabling said alarm system to inhibit generation of said audio alarm signal.

3. A hearing aid as claimed in claim 2 and further comprising an on/off switch for controlling power supplied from said battery.

4. A hearing aid as claimed in claim 3 wherein said means for disabling is automatic.

5. A hearing aid as claimed in claim 2 wherein said means for disabling is automatic.

6. A hearing aid as claimed in claim 1 wherein both the frequency and amplitude of said audio alarm signal increase as the voltage of said battery decreases.

7. A hearing aid as claimed in claim 1 and further comprising a timing circuit for periodically enabling and disabling generation of said audio alarm signal.

8. A hearing aid comprising:

a hearing aid housing;

a hearing aid circuit comprising a microphone for receiving audio and for generating therefrom audio signals and an amplifier for amplifying the audio signals generated by said microphone;

a battery connected to supply power to said hearing aid circuit;

an alarm system mounted with the hearing aid housing for generating an audio alarm signal representative of an audible alarm in response to the voltage output of said battery falling below a predetermined threshold value, said audio alarm signal being directly connected for amplification by said amplifier such that both said audible alarm and said audio received by said microphone can be heard simultaneously by a user, said audible alarm being transmitted into the ear canal of the user such that the audible alarm is heard only by the user.

9. A hearing aid as claimed in claim 8 and further comprising means for disabling said alarm system to inhibit generation of said audio alarm signal.

10. A hearing aid as claimed in claim 9 and further comprising an on/off switch for controlling power supplied from said battery.

11. A hearing aid as claimed in claim 10 wherein said means for disabling comprises said on/off switch.

12. A hearing aid as claimed in claim 9 wherein said means for disabling is automatic.

13. A hearing aid as claimed in claim 8 wherein said signal component is selected from the group consisting of amplitude and frequency.

14. A hearing aid as claimed in claim 13 wherein both the frequency and amplitude of said audio signal increase as the voltage of said battery decreases.

15. A hearing aid as claimed in claim 8 and further comprising a timing circuit for enabling and disabling generation of said audio alarm signal.

* * * * *